US006908278B2

(12) United States Patent
Brunet et al.

(10) Patent No.: US 6,908,278 B2
(45) Date of Patent: Jun. 21, 2005

(54) DEVICE FOR STRAIGHTENING THE FLOW OF AIR FED TO A CENTRIPETAL BLEED IN A COMPRESSOR

(75) Inventors: Antoine Brunet, Moissy-Cramayel (FR); Patrick Pasquis, Moisenay (FR); Alexandre Roy, Moissy-Cramayel (FR)

(73) Assignee: SNECMA Moteurs, Paris (FR)

( * ) Notice: Subject to any disclaimer, the term of this patent is extended or adjusted under 35 U.S.C. 154(b) by 6 days.

(21) Appl. No.: 10/345,184

(22) Filed: Jan. 16, 2003

(65) Prior Publication Data

US 2003/0133787 A1 Jul. 17, 2003

(30) Foreign Application Priority Data

Jan. 17, 2002 (FR) ..... 02 00519

(51) Int. Cl.[7] ..... F01D 5/08
(52) U.S. Cl. ..... 415/115; 415/144
(58) Field of Search ..... 415/115, 120, 415/168.4, 175, 176, 191, 208.1, 208.2, 144

(56) References Cited

U.S. PATENT DOCUMENTS 2,618,433 A * 11/1952 Loos et al. ..... 415/115
2,910,268 A * 10/1959 Davies et al. ..... 415/115
3,085,400 A 4/1963 Sonder et al.
4,787,820 A * 11/1988 Stenneler et al. ..... 416/95

FOREIGN PATENT DOCUMENTS

| | | |
|---|---|---|
| FR | 2 609 500 | 7/1988 |
| FR | 2 614 654 | 11/1988 |
| GB | 712051 | 7/1954 |

* cited by examiner

*Primary Examiner*—Edward K. Look
*Assistant Examiner*—Richard A. Edgar
(74) *Attorney, Agent, or Firm*—Oblon, Spivak, McClelland, Maier & Neustadt, P.C.

(57) ABSTRACT

An axial compressor for a turbomachine is fitted with a device for centripetally bleeding turbine-cooling air. The compressor includes at least two rings of blades, an outer shroud having holes, and a fixed ring of stator vanes placed in the stream between the moving rings of blades. The holes are inlets for the bleed device, opening out into an annular groove beneath the interstice separating the inner platforms of the stator vanes from the rim of the upstream disk. The groove is fitted with fixed air guide devices to impart a centripetal swirling motion to the air flowing therein in the same direction as the compressor so as to reduce the velocity of the air relative to the rotating holes.

19 Claims, 3 Drawing Sheets

DEVICE FOR STRAIGHTENING THE FLOW OF AIR FED TO A CENTRIPETAL BLEED IN A COMPRESSOR

The invention relates to an axial compressor for a turbomachine, the compressor being fitted with a device for centripetally bleeding turbine-cooling air from a stream of air flowing through said compressor, said compressor comprising two rings of moving blades extending radially outwards from the peripheries of two consecutive disks joined together by an outer shroud having holes, and further comprising a fixed ring of stator vanes placed in the stream between said moving rings of blades, said holes serving as air inlets to said bleed device and opening out into an annular groove provided beneath the interstice separating the inner platforms of the stator vanes from the rim of the upstream disk, said groove communicating with said stream via said interstice.

BACKGROUND OF THE INVENTION

The purpose of the centripetal air bleed device placed inside the high pressure rotor is to bring a flow of air bled from a stage of the compressor to stages of the turbine that need to be cooled. It is important for the cooling air that reaches the blading of the high pressure turbine which is subjected to high temperatures to be at a pressure which is sufficient to enable a protective film of air to be formed around the turbine blades, and for the air to be at a temperature that is as low as possible.

The bleed device may include bleed channels formed in the upstream disk, as disclosed in FR 2 609 500 and FR 2 614 654, or bleed tubes placed in the annular cavity between two disks, as disclosed in U.S. Pat. No. 5,475,313.

The flow of air bled from the stream penetrates into the annular groove via the interstice separating the inside platforms of the stator vanes from the rim of the upstream disk by traveling in a direction that is substantially axial, and it then passes through holes in the rotating shroud. It will thus be understood that the velocity of the air at the inlets to the holes relative to the rotating disk is relatively high, which gives rise to an increase in the relative total temperature of the air in the holes and to a non-negligible loss of head in said zone. This temperature increase is naturally to be found in the flow of air delivered to the blades of the turbine. The loss of head decreases the flow rate of the bleed air.

OBJECT AND SUMMARY OF THE INVENTION

The object of the invention is to propose easy-to-implement and low-cost means that, other things remaining equal, enable the temperature of the air delivered to the high pressure turbine to be significantly decreased, and enable head losses to be reduced.

According to the invention, this object is achieved by the fact that the groove is fitted with fixed air guide means imparting centripetal swirling motion on the air flowing in said groove, the motion rotating in the same direction as the compressor so as to reduce the velocity of the air entering into the holes relative to said rotating holes.

As a result, the relative total temperature of the air in the holes is significantly lowered compared with the same temperature in a conventional compressor, thereby improving the cooling of the turbine blades for a given flow rate, and increasing blade lifetime.

Head losses are also reduced, which means that, for identical bleed devices and holes and compared with the prior art, the flow rate of the bleed air is improved, and that the pressure-rise ratio in the turbine blades is increased.

For given lifetime of the turbine blades that are cooled, these two improvements obtained by the invention together make it possible to reduce the air flow needed to cool the blades of the turbine, thereby reducing specific fuel consumption.

Said guide means are disposed at least in part beneath the inner platforms of the stator vanes.

Advantageously, the air guide means in the groove comprise a plurality of guide profiles regularly distributed around the axis of rotation of said compressor.

Preferably, the leading edges of the guide profiles extend at least in part into the interstice.

The angle of incidence of the profiles is determined as a function of the local tangential velocity and radial velocity of the air passing through the interstice.

This makes it possible to avoid altering the vector magnitude of the velocity of the air in the groove, and thus to avoid modifying its static pressure.

The guide profiles increase the coefficient of entrainment of air into the groove, thus making it possible for the same air total temperature to reduce its relative total temperature.

The improvement in the entrainment coefficient due to the proposed guide profiles is about 30% over the prior art, which corresponds to a reduction in the relative total temperature of about 40° C. This enables the lifetime of the turbine blades to be doubled for the same bleed flow rate.

BRIEF DESCRIPTION OF THE DRAWINGS

Other advantages and characteristics of the invention appear on reading the following description given by way of example and made with reference to the accompanying drawings, in which.

MORE DETAILED DESCRIPTION

Figure 1:
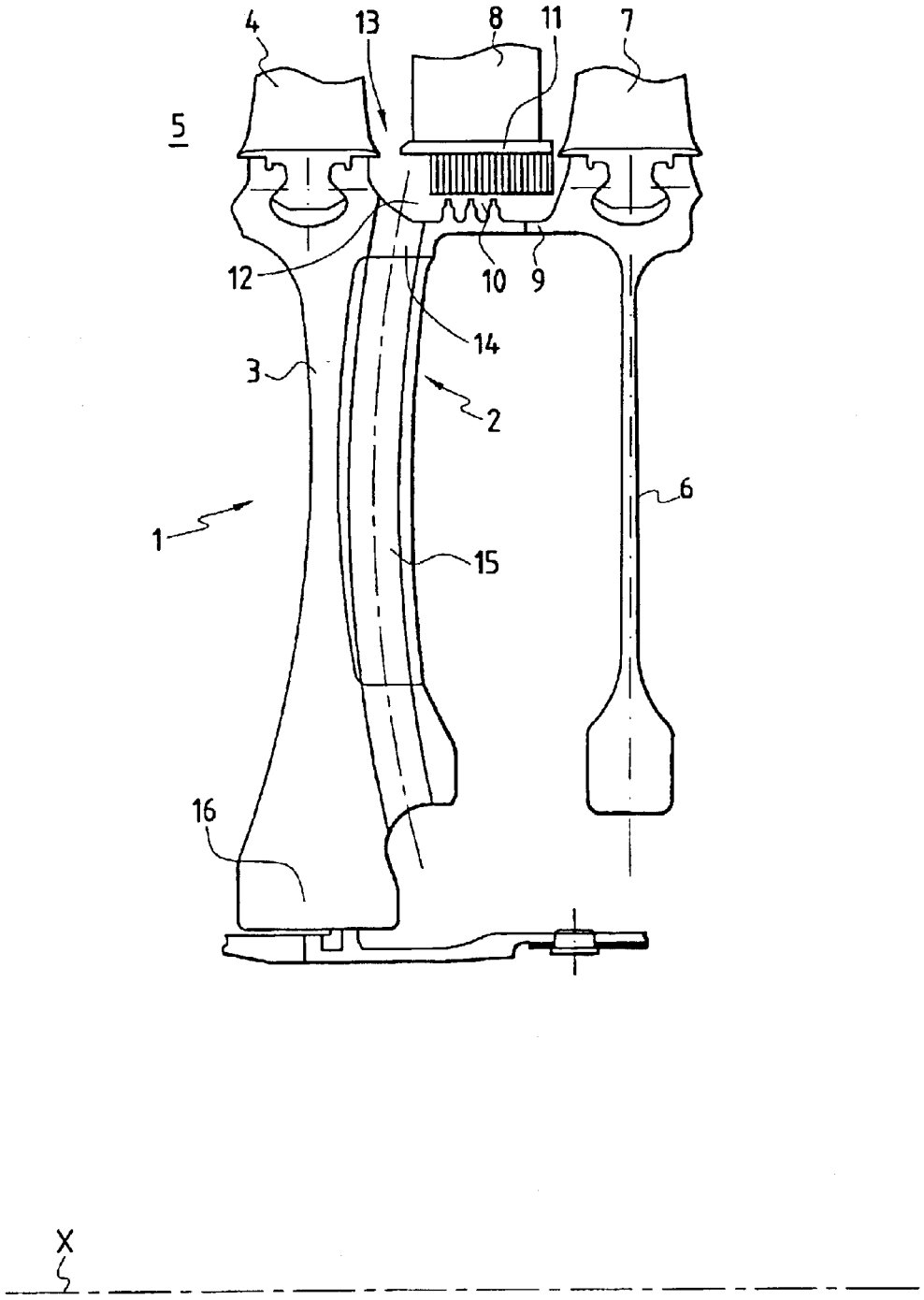
FIG.1 PRIOR ART
FIG. 1 is an axial half-view of a prior art turbomachine compressor fitted with a centripetal air bleed device.

FIG. 1 shows a compressor 1 of a prior art turbomachine of axis X that is fitted with a centripetal bleed device 2.

The compressor 1 comprises an upstream disk 3 having a first ring of moving blades 4 at its periphery, said blades being disposed in a stream 5, a downstream disk 6 presenting a second ring of moving blades 7 at its periphery that are offset axially along the stream 5, and a fixed ring of stator vanes 8 in the stream 5 between the first and second rings of moving blades.

The upstream disk 3 and the downstream disk 6 are interconnected by an outer shroud 9 carrying a sealing labyrinth 10 co-operating with the inside faces of the inner platforms 11 of the stator vanes 8. A groove 12 is formed beneath the interstice 13 which separates the rim of the upstream disk 3 from the inner platforms 11. Holes 14 made through the outer shroud 9 lead to the groove 12. These holes 14 enable a flow of bleed air to be introduced into the centripetal bleed device 2 which, in the example shown in FIG. 1, comprises radial channels 15 formed in the wall of the upstream disk 3. The bleed air is taken radially inwards by the radial channels 15 and it is deflected rearwards by the radially inner portion 16 of the upstream disk 3, after which it flows axially towards the stages of the turbine that drives the compressor 1.

Figure 3:
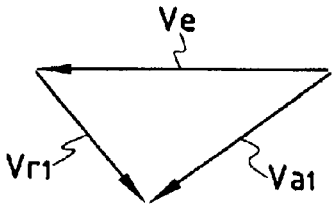
FIG. 3 is a vector diagram of air velocities close to the holes in the absence of air guide means.

The velocity diagram of FIG. 3 shows that the relative velocity $Vr_1$ of the air in the vicinity of the holes 14, i.e. relative to the periphery of the upstream disk 3, is relatively high. $Va_1$ designates the absolute velocity of the air, and Ve represents the velocity of the rim of the disk 3.

Figure 2:
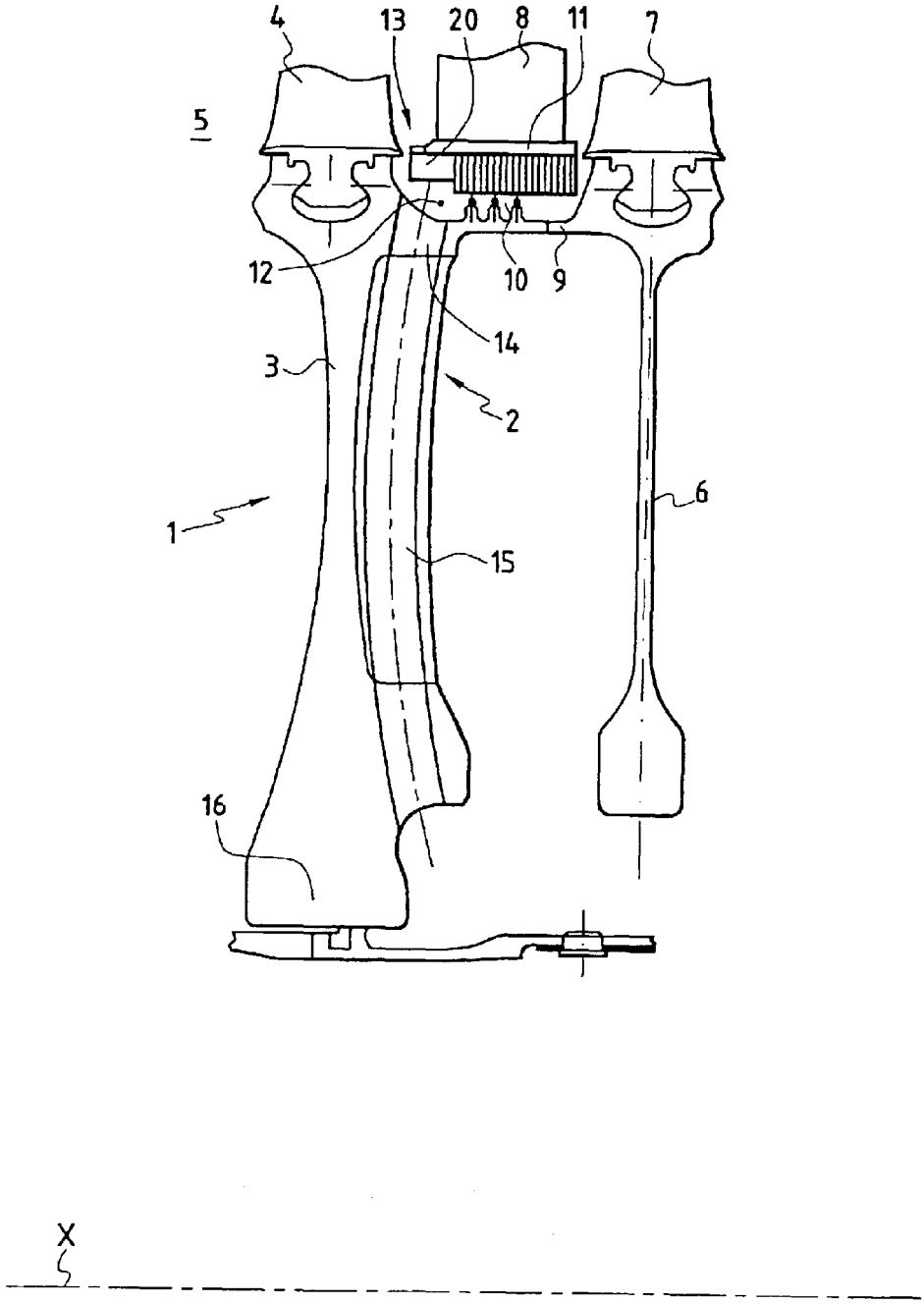
FIG. 2 is an axial half-view of a turbomachine compressor of the invention fitted with the same centripetal air bleed device.

FIG. 2 shows the same compressor 1 fitted with fixed guide means 20 for imparting centripetal swirling motion to the air flowing in the groove 12 between the interstice 13 and the holes 14, said motion being in the direction of rotation of the compressor 1.

Figure 4:
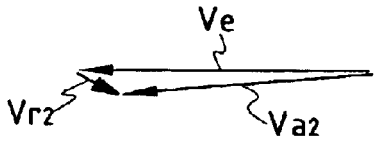
FIG. 4 is a vector diagram of air velocities close to the holes as obtained when using air guide means of the invention.

On leaving these means, the air has an absolute velocity $Va_2$ whose magnitude is equal to the magnitude of the absolute velocity $Va_1$, but which is directed substantially tangentially to the periphery of the outer shroud 9 so that the velocity $Vr_2$ of the air relative to the upstream disk 3 is considerably smaller than the relative velocity $Vr_1$ in the prior art, as can be seen in FIG. 4.

Figure 5:
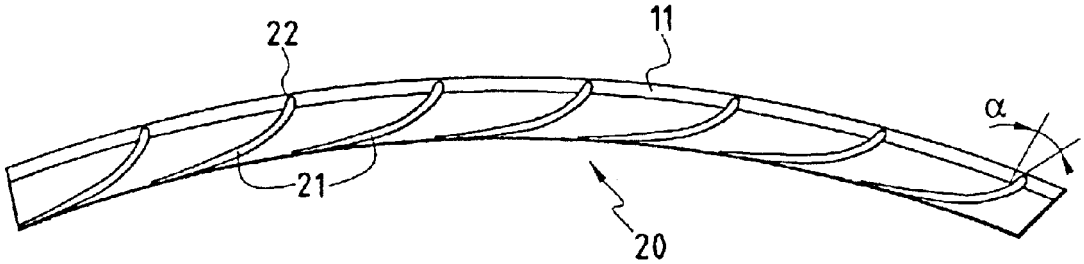
FIG. 5 is an axial view of the air guide profiles in the groove.
Figure 6:
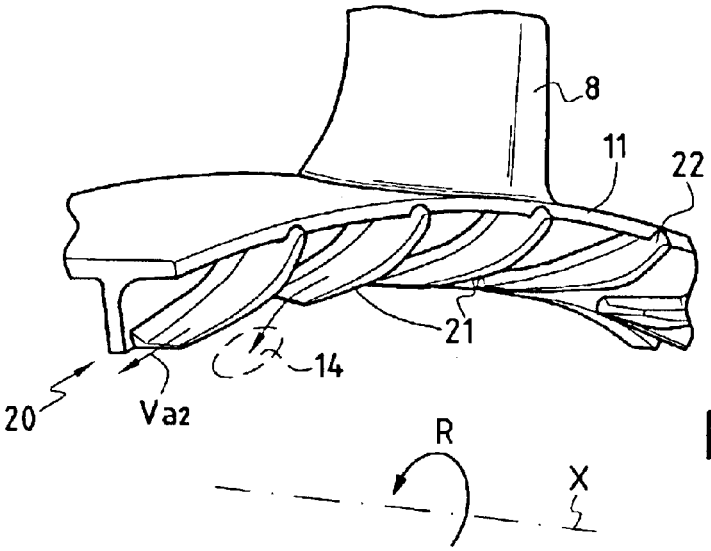
FIG. 6 is a perceptive view of the fronts of the platforms of stator vanes fitted with air guide profiles of the invention.

As shown in FIGS. 2, 5, and 6, the guide means 20 are disposed in the groove 12 beneath the upstream portions of the inner platforms 11 of the stator vanes 8.

These guide means 20 comprise a plurality of guide profiles 21 or fins that are regularly distributed around the axis of rotation X of the compressor 1 having leading edges 22 extending at least in part into the interstice 13. The angle of incidence $\alpha$ of these profiles 21 is determined as a function of the local tangential velocity and the radial velocity of the air passing through the interstice 13.

The guide profiles 21 are designed in such a manner that the air entering through the interstice 13 and flowing between the guide profiles 21 leaves with a velocity $Va_2$ represented by an arrow or vector in FIGS. 4 and 6 that is substantially tangential to the driving velocity Ve of the rotor, so as to reduce significantly the relative velocity $Vr_2$ of the air penetrating into the holes 14.

What is claimed is:

1. An axial compressor for a turbomachine, the compressor being fitted with a device for centripetally bleeding turbine-cooling air from a stream of air flowing through said compressor, said compressor comprising two rings of moving blades extending radially outward from peripheries of two consecutive disks joined together by an outer shroud having holes, and further comprising a fixed ring of stator vanes placed in the stream between said moving rings of blades, said holes serving as air inlets to said bleed device and opening out into an annular groove provided beneath an interstice separating inner platforms of the stator vanes from a rim of the upstream disk, said groove communicating with said stream via said interstice, wherein the groove is fitted with fixed air guide means imparting centripetal swirling motion on the air flowing in said groove, the motion rotating in the same direction as the compressor so as to reduce a velocity of the air entering into the holes relative to said rotating holes.

2. A compressor according to claim 1, wherein said guide means are disposed at least in part beneath the inner platforms of the stator vanes.

3. A compressor according to claim 2, wherein said air guide means in the groove comprise a plurality of guide profiles regularly distributed around the axis of rotation of said compressor.

4. A compressor according to claim 3, wherein the leading edges of the guide profiles extend at least in part into the interstice.

5. A compressor according to claim 4, wherein the angle of incidence of the profiles is determined as a function of the local tangential velocity and radial velocity of the air passing through the interstice.

6. A compressor according to claim 1, wherein the bleed device comprises bleed channels formed in the upstream disk.

7. A compressor according to claim 1, wherein the guide means are disposed substantially underneath an upstream portion of the inner platforms and fixed to said upstream portion.

8. A compressor according to claim 1, wherein a reduction in relative total temperature of the bleed air is about 40° C.

9. A compressor according to claim 1, wherein an absolute velocity of the air leaving the guide means is substantially directed tangentially to a periphery of the outer shroud.

10. A compressor according to claim 9, wherein the absolute velocity is substantially equal to an absolute velocity of the disk rim.

11. A compressor according to claim 5, wherein a velocity of the air in the groove is substantially unaltered.

12. A compressor having a device configured to centripetally bleed turbine-cooling air from an air stream flowing there through, the compressor comprising:

an upstream ring of rotor blades and a downstream ring of rotor blades, both rings extending radially outward from peripheries of two consecutive upstream and downstream disks, respectively, joined together by an outer shroud having bleed air inlet holes;

a fixed ring of stator vanes placed between the upstream and downstream rings of rotor blades;

an annular groove provided beneath an interstice separating an inner platform of the stator vanes from a rim of the upstream disk, the air inlet holes opening out into the annular groove and the groove communicating with the air stream via the interstice; and stationary air guide vanes fitted to the annular groove and disposed adjacent to the upstream disk substantially underneath an upstream portion of the inner platform of the stator vanes, the stationary air guide vanes being configured to impart a centripetal swirling motion to the bleed air in the same direction as a compressor rotation direction so as to reduce a velocity of the air entering into the holes relative to the rotating holes.

13. A compressor according to claim 12, wherein the stationary air guide vanes comprise a plurality of guide profiles regularly distributed around the axis of rotation of said compressor.

14. A compressor according to claim 13, wherein the leading edges of the guide profiles extend at least in part into the interstice.

15. A compressor according to claim 14, wherein an angle of incidence of the profiles is determined as a function of a local tangential velocity and a radial velocity of the air passing through the interstice.

16. A compressor according to claim 12, wherein a reduction in relative total temperature of the bleed air is about 40° C.

17. A compressor according to claim 12, wherein an absolute velocity of the air leaving the stationary air guide vanes is substantially directed tangentially to a periphery of the outer shroud.

18. A compressor according to claim 17, wherein the absolute velocity is substantially equal to an absolute velocity of the disk rim.

19. A compressor according to claim 15, wherein a velocity of the air in the groove is substantially unaltered.

* * * * *